United States Patent [19]

Tamesui et al.

[11] 3,967,414

[45] July 6, 1976

[54] GRINDING MACHINE WITH A REST APPARATUS

[75] Inventors: Tsuyoshi Tamesui, Okazaki; Shuichi Nakata, Kariya; Minoru Enomoto, Handa, all of Japan

[73] Assignee: Toyoda Koki Kabushiki Kaisha, Japan

[22] Filed: Feb. 7, 1975

[21] Appl. No.: 548,020

[30] Foreign Application Priority Data

Feb. 12, 1974 Japan ..... 49-17303

[52] U.S. Cl. ..... 51/165.77; 51/238 S

[51] Int. Cl.[2] ..... B24B 49/00

[58] Field of Search ..... 51/238 S, 105 SP, 165.77

[56] References Cited

UNITED STATES PATENTS

| | | | |
|---|---|---|---|
| 2,638,719 | 5/1953 | Balsiger | 51/238 S X |
| 3,153,884 | 10/1964 | Balsiger | 51/165 R |
| 3,330,074 | 7/1967 | Stuckey | 51/238 S X |
| 3,878,651 | 4/1975 | Makada et al. | 51/165.77 |

*Primary Examiner*—Harold D. Whitehead

*Attorney, Agent, or Firm*—Oblon, Fisher, Spivak, McClelland & Maier

[57] ABSTRACT

In a grinding machine, a rest apparatus is advanced to move a workpiece toward a grinding wheel being in a stationary condition after a preliminary grinding operation. After a predetermined amount of advancement of the rest apparatus, the grinding wheel is again advanced to grind the workpiece while the rest apparatus is stationary until the workpiece deviates from engagement with the rest apparatus, whereby after a final grinding operation, the workpiece is ground at the true center thereof so as to be in true roundness and with good concentricity.

8 Claims, 4 Drawing Figures

GRINDING MACHINE WITH A REST APPARATUS

BACKGROUND OF THE INVENTION

1. Field of the Invention

The present invention relates generally to a grinding machine and more particularly to a grinding machine with a rest apparatus for supporting a workpiece.

2. Description of the Prior Art

In the prior art for grinding a workpiece by using a rest apparatus, a grinding operation has been performed in such a manner that the rest apparatus is advanced toward the workpiece at a slightly faster rate than the advancing speed of a grinding wheel after the grinding wheel has advanced to a predetermined position, and wherein the grinding wheel grinds the workpiece on the condition that the rest apparatus is in contact with the workpiece.

According to such prior method, because the rest apparatus is initially in contact with a workpiece which has not been ground to sufficiently acceptable roundness and a grinding operation is finished on the condition that the rest apparatus is in contact with the workpiece, the original out of roundness of the workpiece affects the final roundness of the finished workpiece and creates an external configuration which deviates from the true center thereof. Because the advancing speed of the rest apparatus is slightly faster than that of the grinding wheel, significant deflection is given to the workpiece by the rest apparatus.

Such excess deflection causes the workpiece to be ground with an external configuration which deviates from the true center thereof.

SUMMARY OF THE INVENTION

It is therefore an object of the present invention to provide a grinding machine with a rest apparatus for supporting a workpiece so as to grind the workpiece in good roundness and in concentricity with the true center thereof.

It is another object to provide a grinding machine with a rest apparatus including means to advance the grinding wheel for a preliminary grinding operation after which the grinding wheel is held stationary and then to advance a rest apparatus for engaging with and bending the workpiece whereby the workpiece is ground by the grinding wheel while in a stationary condition.

It is another object to provide a grinding machine with a rest apparatus including means for advancing a grinding wheel until the workpiece deviates from engagement with the rest apparatus after grinding of the workpiece by rest apparatus while maintaining the grinding wheel stationary.

It is another object to provide a grinding machine with a rest apparatus including means for stopping advancement of the grinding wheel in response to a first gauge signal and for advancing a rest apparatus for engaging with and bending the workpiece, which is ground by the grinding wheel until a second gauge signal is produced.

It is another object to provide a grinding machine with a rest apparatus wherein the amount of advancement of a rest apparatus is accurately set to a predetermined value by measuring a differential diameter of a workpiece after and before the workpiece is engaged and moved by the rest apparatus and, wherein a grinding wheel is thereafter advanced until the workpiece deviates from engagement with the rest apparatus, whereby, after a final grinding, the workpiece is ground according to the true center thereof so as to be ground in good roundness and with good concentricity.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference characters designate the same or similar parts throughout the Figures thereof and wherein.

DESCRIPTION OF A PREFERRED EMBODIMENT

Figure 1:
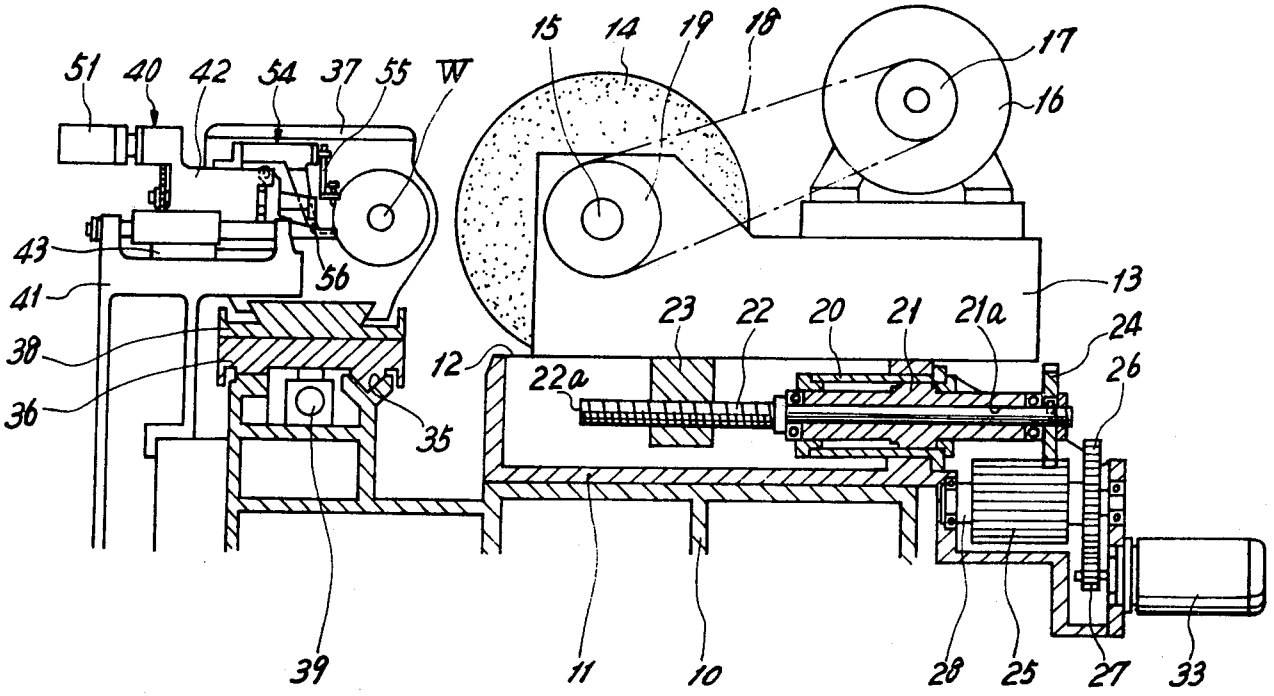
FIG. 1 is a partially sectional side view of a grinding machine with a rest apparatus according to the present invention.

Numeral 10, as shown in FIG. 1, indicates a bed on which a slide base 11 is fixedly mounted. Slidably guided on slideways 12, formed on the slide base 11, is a wheel support 13 in which a wheel spindle 15 with a grinding wheel 14 is rotatably supported. The grinding wheel is rotated by a motor 16 through a belt 18 engaging with a spindle pulley 19 and a motor pulley 17.

Fixedly mounted in the slide base 11 is a rapid feed cyclinder 20 in which a piston 21 is slidably mounted. An infeed screw 22 passes through a bore **21*a* in the piston 21 and is rotatably supported therein, but restrained from axial movement relative to the piston 21. The infeed screw 22 has a threaded portion 22*a* at one end in engagement with a nut 23 depending from the wheel support 13, and has at the other end thereof a gear 24 fixedly mounted thereon. On a supporting shaft 28, mounted on the slide base 11, are reduction gears 25 and 26. The gear 26 meshingly engages with a gear 27 of a pulse motor 33. The gears 24 and 25 are meshingly engaged with each other in slidable relationship such that the wheel support 13** may move in a rapid feed stroke.

Accordingly, a feed mechanism for the wheel support is formed by the infeed screw 22, nut 23, gears 24 to 27 and pulse motor 33.

Formed on the bed 10 is a slide way 35 transverse to the slide way 12, and a slide table 36 is slidably guided thereon. On the slide table 36, is a swivel table 38 on which a pair of work supports 37, one of which is shown, are mounted for supporting both ends of a workpiece W. The workpiece is rotated by a motor which is not shown. The slide table 36 is transversely moved by a cylinder 39 fixedly mounted on the bed 10.

Numeral 40 indicates a rest device.

A rest base 41 is opposed to the grinding wheel 14 and is fixedly mounted on the bed 10. Slidably mounted on the rest base 41 is a rest device body 42 which is moved forwardly into and backwardly from a workpiece by a cylinder 43 mounted on the rest base 41.

Figure 2:
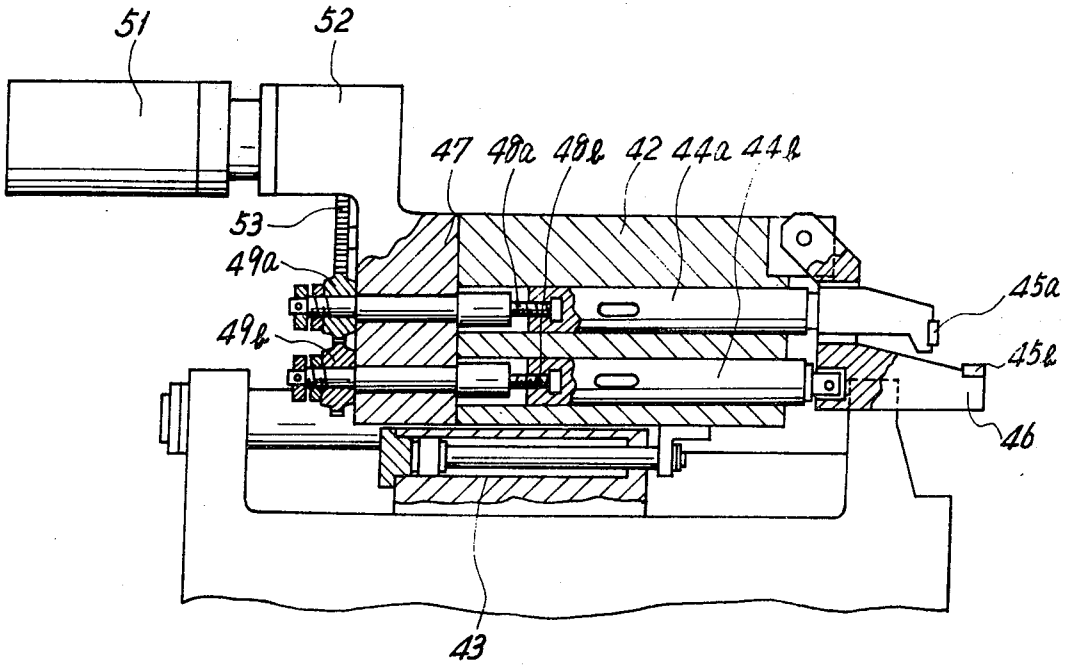
FIG. 2 shows a partially sectional side view of the rest apparatus shown in FIG. 1.

As shown in FIG. 2, a pair of slide rods **44*a*, 44*b* are slidably mounted in body 42 in non-rotatable relationship therewith. Fixedly mounted at the end of the upward slide rod 44*a* is a feeler 45*a* for horizontally supporting a workpiece W. The lower slide rod 44*b* is pivotally connected at the forward end to a L-formed arm 46 which is pivoted at the front of the rest device body 42 so as to upwardly and downwardly move a feeler 45***b* fixedly mounted at the end of the arm 46.

A feeler feed device for moving the feelers 45*a*, 45*b* toward and away from a workpiece W is described as follows.

Screw shafts 48*a* and 48*b* are journaled in a bracket 47 fixed to the rear end of the body 42, and have threads formed in opposed directions with each other which threadedly engage with the rear ends of slide rods 44*a* and 44*b* respectively. Gears 49*a* and 49*b*, which meshingly engage with each other, are fixed at the rear ends of the screw shafts 48*a* and 48*b*, respectively. Fixed to the bracket 47 is a pulse motor 51, the rotation of which is transmitted to the gears 49*a*, 49*b* and the screw shafts 48*a*, 48*b* through an output gear 53 in a reduction mechanism 52. Since the threads formed on the screw shafts 48*a*, 48*b* are in opposed directions with each other, the slide rods 44*a*, 44*b* are synchronously moved in advance and in retraction so that the feelers 45*a*, 45*b* may be moved respectively horizontally and vertically toward an axis of a workpiece W. As shown in FIG. 1, provided at the front in the body 42 is an automatic gauge 54 having a pair of feelers 55, 56 which contact the peripheral surface of a workpiece when the gauge 54 arrives at advanced position thereof. According to the vertical movement of the feelers 55, 56, the feelers 55, 56 actuate a differential transformer, which is not shown, from which voltage is produced in proportion to a workpiece diameter.

Figure 3:
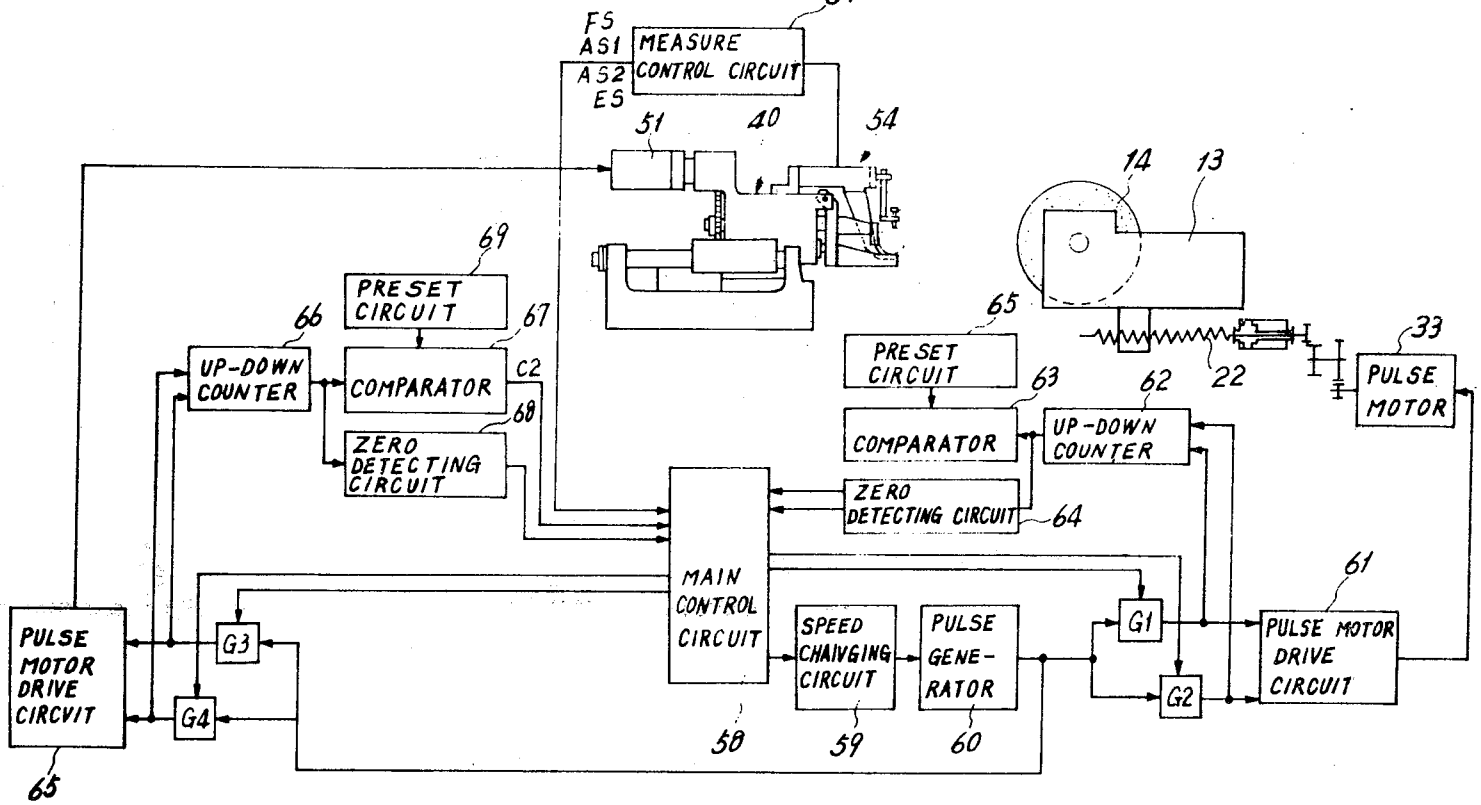
FIG. 3 shows a block diagram of a control system.

The differential transformer is connected with a measure control circuit 57, as shown in FIG. 3, which feeds to a main control circuit 58 a fine grinding signal FS when a workpiece is reduced to a finish size with stock removal being left for finishing grinding. The measure control circuit 57 further feeds to the main control circuit 58 a first signal AS1, a second signal AS2 and a size signal ES in the sequence of reduction in a workpiece diameter, respectively, when a workpiece is ground to a first predetermined size, a second predetermined size and a size.

A speed changing circuit 59 provides voltage corresponding to a speed command from the main control circuit 58 to a pulse generator 60 which delivers to gate circuits G1, G2 a train of pulses having a frequency representing the velocity corresponding to the speed command. The main control circuit 58 opens the gate circuit G1 so as to deliver drive pulses to a terminal for forward rotation in a pulse motor drive circuit 61 and to a terminal for addition in an up-down counter 62 when the wheel support 13 is to be advanced, and opens the gate circuit G2 so as to deliver drive pulses to a terminal for reverse rotation in pulse motor drive circuit 61 and to a terminal for subtraction in the up-down counter 62 when the wheel support 13 is to be retracted. An output of the up-down counter 62 is supplied to a comparator 63 and to a zero detecting circuit 64. The comparator circuit supplies a coincident signal C1 to the main control circuit 58 when the content in the up-down counter coincides with that in a preset circuit 65. The zero detecting circuit 64 supplies a zero confirmation signal to the main control circuit 58 when the content in the up-down counter 62 becomes zero.

The pulse generator 60 also delivers drive pulses to gate circuits G3, G4 to drive the pulse motor 51. The main control circuit 58 opens, when the feelers 45*a*, 45*b* in the rest device are to be advanced, the gate circuit G3 for delivering drive pulses to a terminal for forward rotation of a pulse motor drive circuit 65 connected with the pulse motor 51 and to a terminal for addition of an up-down counter 66, and opens, when they are to be retracted, the gate circuit G4 for delivering drive pulses to a terminal for reverse rotation of the drive circuit 65 and a terminal for subtraction in the up-down counter 66. An output of the up-down counter 66 is supplied to a comparator 67 and a zero detecting circuit 68. The main control circuit 58 receives a coincident signal C2 from the comparator 67 upon coincidence of the content in the up-down counter 66 with a content in a preset circuit 69, and a zero confirmation signal from the zero detecting circuit 68 when the content in the up-down counter 66 becomes zero.

OPERATION

Figure 4:
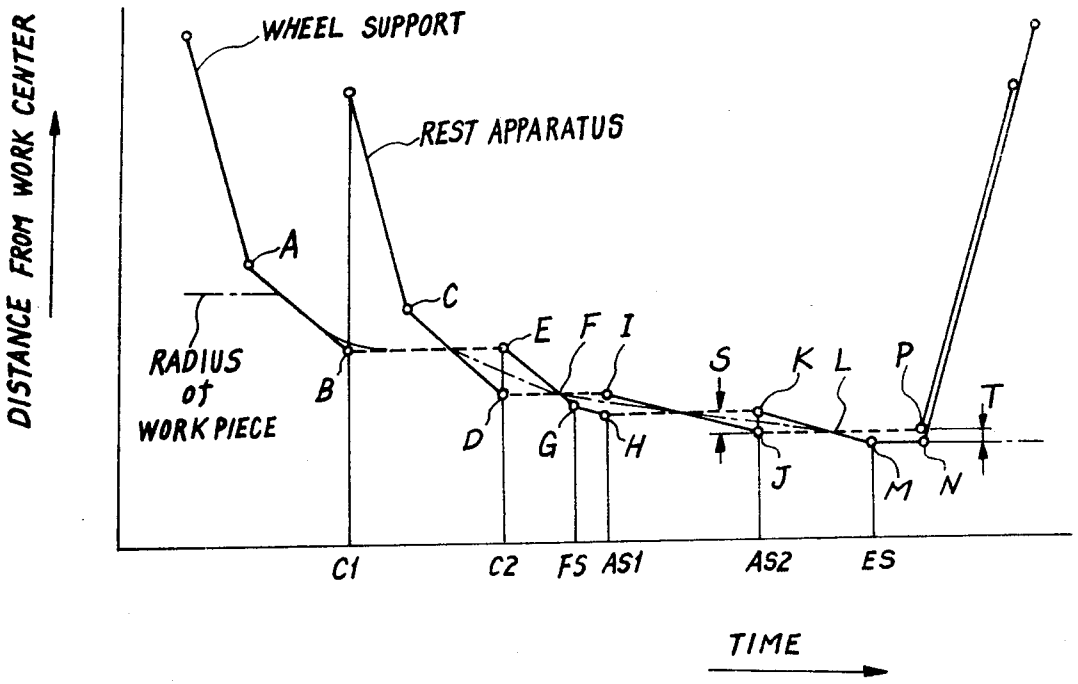
FIG. 4 shows a feeding cycle diagram of a wheel support and rest apparatus.

Referring now to the grinding cycle diagram, shown in FIG. 4, the operation of the present embodiment is described.

When the main control circuit 58 receives a starting command, fluid under pressure is supplied to the right chamber in the rapid feed cylinder 20 to advance the piston 21 to thereby advance the wheel support 13 to a "A" position at a rapid feed rate through the infeed screw 22 and the nut 23. When the piston 21 has arrived at the advanced position thereof, the gate circuit G1 is opened to deliver drive pulses from the pulse generator 60 to the pulse motor drive circuit 61. Accordingly, the pulse motor 33 is rotated forwardly to advance the wheel support 13 from the "A" position toward the "B" position. As a result of this movement, since the pulse generator 60 is controlled by the speed change circuit 59 to deliver drive pulses having a comparatively high frequency, the grinding wheel 14 grinds a workpiece W at a rough grinding infeed rate. Each time a pulse is delivered to the drive circuit 61, the same pulse is also supplied to the up-down counter 62. When the content of the up-down counter 62 coincides with that in the preset circuit 65, a coincident signal C1 is supplied from the comparator 63 to the main control circuit 58. Accordingly, the main control circuit 58 closes the gate circuit G1 to stop the advance movement of the wheel support 13 at the "B" position and actuates the cylinder 43 to advance the rest device 42 toward a workpiece W. The feeders 55, 56 of the gauge 54 contact the peripheral surface of a workpiece W so that voltage in proportion with the diameter of the workpiece is produced from the differential transformer at the advanced position of the cylinder 43. However, at this time the feelers 45*a*, 45*b* of the rest device 40 are adjusted to be unengageable with the peripheral surface of a workpiece W. At the advanced position "C" of the rest device 42, the gate circuit G3 is opened to supply the pulses from the pulse generator 60 to the pulse motor drive circuit 65 to forwardly rotate the pulse motor 51. Since the screw shafts 48*a*, 48*b* are rotated through the gears, the slide rods 44*a*, 44*b* are advanced toward the workpiece W at a speed equal to the rough grinding speed of the wheel slide to thereby cause the feelers 45*a*, 45*b* to contact therewith. When the feelers 45*a*, 45*b* are further advanced, a workpiece is bent toward the grinding wheel 14, the feed of which is being stopped, so as to be ground thereby. Each time a pulse is supplied to the drive circuit 65, the same pulse is also supplied to the up-down counter 66. When the content of the up-down counter 66 coincides with the preset value in the preset circuit 69, a coincident signal C2 is supplied to the main control circuit 58 so as to close the gate circuit G3 whereby the advance movement of the rest device 40 is stopped at the "D" position. The gate circuit G1 is opened by the coincident signal C2 to start the wheel support so that the workpiece W is ground again by the grinding wheel 14 at a rough grinding feed rate (E position).

The workpiece W is ground in good roundness because of being ground in the condition supported by the feelers 45*a*, 45*b* of the rest device 40 in stoppage.

When ground and decreased in diameter, the workpiece is gradually released from the deflection caused by the rest device 40. After the point F, the workpiece is ground in a condition unsupported by the rest device 40. In this process, the workpiece is ground in good roundness and in good symmetry with the axis of rotation thereof.

When the workpiece is reduced to a finish size with a stock removal being left for finishing grinding (point G), the fine grinding signal is supplied by the measure control circuit 57 to the main control circuit 58 which commands a fine grinding speed to the speed changing circuit 59. Accordingly, a voltage charged by the speed changing circuit 59 is reduced so that the pulse generator may supply a low frequency pulse train to advance the wheel support at a fine speed.

When the workpiece W becomes reduced to the first predetermined size by fine grinding, a first signal AS1 is supplied from the measure control circuit 57. According to the first signal AS1, the main control circuit 58 closes the gate circuit G1 and stops temporary advancement of the wheel support 13 (H point) and opens the gate circuit G3 to thereby advance the rest device 40 again (I point) at a speed equal to the fine feed speed of the wheel slide. The feelers 45*a*, 45*b* of the rest device 40 contact the peripheral suface of the workpiece to press it toward the grinding wheel which is stationary whereby the workpiece is bent while being ground. When the workpiece W becomes reduced to the second predetermined size, the second signal AS2 is supplied by the measure control circuit 57 to the main control circuit 58 so as to close the gate circuit G3 to stop the advancement of the rest device 40 (J point). Half the difference of the first and second predetermined sizes is a plunge value (S/2) for bending the workpiece toward the grinding wheel 14 and the plunge value is accurately controlled by the automatic gauge 54. According to the second signal AS2, the gate circuit G1 is opened by the main control circuit 58 to advance the wheel support 13 at a fine grinding speed again (K point). In this process, the workpiece W is also supported by the rest device 40 to be ground thereby in good roundness. According to the decrease of the workpiece W in diameter, it is gradually released from the deflection caused by the rest device 40. After the "L" point, it is finely ground in an unsupported condition and deflection thereof is removed.

However, if a fine grinding machining after the "L" point proceeds for a long time, the grinding accuracy becomes worse. In the present invention, the value for plunging the workpiece W to the grinding wheel is exactly determined by two size signals AS1, AS2 and a grinding stock T from the "L" point to the "M" point is preset exactly.

After proceeding with the fine grinding operation, when the workpiece W is ground to a size, a size signal ES is supplied by the measure control circuit 57 to the main control circuit 58 to close the gate circuit G1 to thereby stop the wheel support 13 ("M" point) to proceed the sparkout on the workpiece for a predetermined time. After the sparkout grinding operation is finished, the main control circuit 58 opens the gate circuits G2, G4 to reverse rotation of the pulse motors 33, 51 to retract the wheel support 13 and the rest device 40 ("N" point). Each time a pulse is delivered to the pulse motors 33, 51 the content of the up-down counters 62, 55 is subtracted. When the content of the up-down counters 62, 64 becomes zero, a zero confirmation signal is produced by the zero detecting circuits 64, 68 to close the gate circuits G2, G4. At the same time with the reverse rotation of the pulse motors 33, 51, the wheel support 13 and the rest body 42 are also retracted by the cylinders 20, 43 to the retracted end thereof. The wheel support 13 and the rest device 40 are returned at the original position to finish one grinding cycle.

Obviously, many modifications and variations of this invention are possible in light of these teachings. It is to be understood therefore that within the scope of the appended claims, the present invention may be practiced otherwise than an specifically described herein.

What is claimed as new and intended to be covered by Letters Patent is:

1. A grinding machine comprising:

work support means for rotatably supporting a workpiece, a wheel support to rotatably support a grinding wheel, rest means for support said workpiece and for bending the same toward said grinding wheel, means for advancing said wheel support for a preliminary grinding operation and for stopping the same at a predetermined position while maintaining engagement between said grinding wheel and said workpiece, means for advancing said rest means for bending said workpiece toward said grinding wheel while said wheel support is stationary and for stopping said rest means after said workpiece has been ground by said grinding wheel with a predetermined stock removal being left, and means for re-advancing said wheel support after stopping of said rest means for grinding said workpiece until it deviates from engagement with said rest means whereby the same will be positioned at its rotational center.

2. A grinding machine comprising:

work support means for rotatably supporting a workpiece, a wheel support to rotatably support a grinding wheel, means for advancing said wheel support at a first feed rate and a second feed rate which is slower than said first feed rate, rest means for engaging with said workpiece and for bending the same toward said grinding wheel, means for stopping the forward motion of said wheel support intermediate of said first feed rate advancement of said wheel support, means for stopping the forward motion of said wheel support after said second feed rate advancement of said wheel support, means for advancing said rest means for engaging with and bending said workpiece when said wheel support is stopped and for stopping said rest means after said workpiece has been ground in engagement with said grinding wheel, and means for advancing said wheel support after the second stoppage thereof for grinding until said workpiece deviates from engagement with said rest means whereby the same will be positioned at its rotational center.

3. A grinding machine comprising:

work support means for rotatably supporting a workpiece, a wheel support to rotatably support a grinding wheel, means for advancing said wheel support at first, second, and third feed rates, rest means to engage with said workpiece and bend the same toward said grinding wheel, means for stopping the forward motion of said wheel support between said first and said second feed rate advancement of said wheel support, means for stopping the forward motion of said wheel support after said second feed rate advancement of said wheel support, means for advancing said rest means for engaging and bending said workpiece toward said grinding wheel during said stoppages of said wheel support and for stopping said rest means after said workpiece has been ground by said grinding wheel, and means for advancing said wheel support at said third feed rate after said second stoppage thereof so as to grind said workpiece until said workpiece deviates from engagement with said rest means whereby the same will be positioned at its rotational center.

4. A grinding machine according to claim 3, wherein said rest means is advanced respectively at speed rates substantially the same as said first and second feed rates during said stoppages of said wheel support.

5. A grinding machine comprising:

work support means for rotatably supporting a workpiece, a wheel support to rotatably support a grinding wheel, means for feeding said wheel support, rest means for engaging with said workpiece and for bending the same toward said grinding wheel, gauge means for producing a first signal when said workpiece is ground to a predetermined size and a second signal when of a size less than said predetermined size, and control means for advancing said feeding means for a preliminary grinding operation, for stopping the same in response to said first signal for advancing said rest means for engaging and bending said workpiece so that it may be ground by said grinding wheel until said second signal is produced and for again advancing said feeding means in response to said second signal, until said workpiece deviates from engagement with said rest means whereby the same will be positioned at its rotational center.

6. A grinding machine according to claim 5, wherein said control means comprises:

a pulse generator, first gate means for controlling an amount of pulses sent from said pulse generator to said feeding means, and second gate means for controlling an amount of pulses sent from said pulse generator to said rest means, whereby said first and second gates are respectively closed in response to said first and second signals.

7. A grinding machine comprising, work support means for rotatably supporting a workpiece, a wheel support to rotatably support a grinding wheel, means for feeding said wheel support at a first feed rate and a second feed rate which is slower than said first feed rate, rest means for engaging said workpiece and for bending the same toward said grinding wheel, gauge means for producing a fine grinding signal, a first signal and a second signal, and control means for advancing said feeding means at said first feed rate, for changing the speed rate of said feeding means from said first feed rate to said second feed rate in response to said fine grinding signal, for stopping the same in response to said first signal, for advancing said rest means in response to said first signal for engaging and bending said workpiece, for stopping said rest means after said workpiece has been ground by said grinding wheel until said second signal is produced, and for re-advancing said feeding means in response to said second signal until said workpiece deviates from engagement with said rest means whereby the same will be positioned at its rotational center.

8. A grinding machine according to claim 7, wherein said control means comprises a speed changing means actuated in response to said fine grinding signal, a pulse generator controlled by said speed changing means, first gate means for controlling an amount of pulses sent from said pulse generator to said feeding means, and second gate means for controlling an amount of pulses sent from said pulse generator to said rest means, whereby said first and second gates are respectively closed in response to said first and second signals.

* * * * *